US010597177B2

(12) United States Patent
Lindberg et al.

(10) Patent No.: US 10,597,177 B2
(45) Date of Patent: Mar. 24, 2020

(54) APPARATUS AND METHOD FOR FILLING A PRODUCT INTO A CONTAINER

(71) Applicant: Tetra Laval Holdings & Finance S.A., Pully (CH)

(72) Inventors: Peter Lindberg, Malmö (SE); Gert Ekberg, Furulund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 219 days.

(21) Appl. No.: 15/567,702

(22) PCT Filed: Apr. 20, 2016

(86) PCT No.: PCT/EP2016/058788

§ 371 (c)(1),
(2) Date: Oct. 19, 2017

(87) PCT Pub. No.: WO2016/170004

PCT Pub. Date: Oct. 27, 2016

(65) Prior Publication Data

US 2018/0086617 A1 Mar. 29, 2018

(30) Foreign Application Priority Data

Apr. 22, 2015 (SE) ..... 1550481

(51) Int. Cl.
*B65B 3/12* (2006.01)
*B65B 39/06* (2006.01)
(Continued)

(52) U.S. Cl.
CPC ..... *B65B 3/12* (2013.01); *B65B 3/30* (2013.01); *B65B 39/001* (2013.01); *B65B 39/06* (2013.01);
(Continued)

(58) Field of Classification Search
CPC ..... B65B 3/12; B65B 3/30; B65B 39/001; B65B 39/12; B65B 43/58; B67C 3/007; B67C 3/24; B67C 3/28
(Continued)

(56) References Cited

U.S. PATENT DOCUMENTS 2,651,445 A * 9/1953 Kennedy, Jr. ..... B65B 39/12 141/280
4,108,221 A * 8/1978 Freimuth ..... B65B 3/323 141/146
(Continued)

FOREIGN PATENT DOCUMENTS

EP 1281616 A1 2/2003
RU 2043268 C1 9/1995

OTHER PUBLICATIONS

International Search Report for App. No. PCT/EP2016/058778, dated Aug. 26, 2016, in 3 pages.
(Continued)

*Primary Examiner* — Timothy L Maust
(74) *Attorney, Agent, or Firm* — Knobbe, Martens, Olson & Bear, LLP

(57) ABSTRACT

An apparatus for filling a product into a container is provided. The apparatus can include a filling unit to deliver the product into the container; a drive unit to move the container in relation to the filling unit between a first position, in which a bottom end of the container is arranged at a maximum distance from the filling nozzle, and a second position, in which the bottom end of the container is arranged at a minimum distance from the filling nozzle, and a controller to controlling delivery of the product through the filling nozzle, to control the drive unit, and to calculate a new drive unit motion profile for controlling movement from said second position to said first position.

20 Claims, 9 Drawing Sheets

(51) Int. Cl.

| | |
|---|---|
| ***B65B 39/12*** | (2006.01) |
| ***B65B 43/59*** | (2006.01) |
| ***B65B 57/14*** | (2006.01) |
| ***B67C 3/00*** | (2006.01) |
| ***B67C 3/24*** | (2006.01) |
| ***B67C 3/28*** | (2006.01) |
| ***B65B 3/30*** | (2006.01) |
| ***B65B 39/00*** | (2006.01) |

(52) U.S. Cl.
CPC ..... *B65B 39/12* (2013.01); *B65B 43/59* (2013.01); *B65B 57/145* (2013.01); *B67C 3/007* (2013.01); *B67C 3/24* (2013.01); *B67C 3/28* (2013.01)

(58) Field of Classification Search
USPC ..... 141/275, 276, 374
See application file for complete search history.

(56) References Cited

U.S. PATENT DOCUMENTS 4,506,710 A * 3/1985 Sawvel ..... B65B 39/00 141/100
4,535,823 A 8/1985 Powers
4,807,673 A * 2/1989 Tazuke ..... B67C 3/04 141/5
4,915,146 A 4/1990 Warner
4,966,205 A * 10/1990 Tanaka ..... A45D 40/16 141/104
5,095,955 A * 3/1992 Barnewitz ..... B65B 43/62 141/1
5,402,834 A 4/1995 Levin et al.
5,720,326 A 2/1998 Kaneko
5,758,698 A * 6/1998 Kaneko ..... B65B 39/004 141/148
5,791,386 A * 8/1998 Haslach ..... B65B 39/00 141/165
5,819,821 A * 10/1998 Giacomelli ..... B65B 39/001 141/263
5,819,823 A * 10/1998 Brandstrom ..... B65B 39/004 141/311 A
5,996,650 A 12/1999 Phallen et al.
6,286,566 B1 9/2001 Cline et al.
6,397,909 B1 6/2002 Nelson
6,648,025 B2 * 11/2003 Smith ..... B67D 1/0007 141/173
7,650,916 B2 * 1/2010 Clusserath ..... B67C 3/002 141/198
7,730,912 B2 6/2010 Blichmann
7,958,915 B2 6/2011 Maguire
8,037,907 B2 10/2011 Haas et al.
8,146,625 B2 4/2012 Xin et al.
8,985,164 B2 * 3/2015 Seeman ..... B65B 3/30 141/5
10,279,939 B2 * 5/2019 Domeier ..... B29C 49/12
2002/0139436 A1 * 10/2002 Rosen ..... B67C 3/001 141/86
2004/0182469 A1 9/2004 Concetti
2005/0019108 A1 * 1/2005 Rainville ..... B65G 53/24 406/171
2008/0083475 A1 * 4/2008 Lamb ..... B65B 3/26 141/198
2009/0283175 A1 11/2009 Husard
2016/0052767 A1 2/2016 Eaton et al.
2017/0050753 A1 * 2/2017 Glock ..... B65B 39/004

OTHER PUBLICATIONS

International Search Report for App. No. PCT/EP2016/058781, dated Jul. 22, 2016, in 3 pages.
International Search Report for App. No. PCT/EP2016/058785, dated Jul. 22, 2016, in 3 pages.
International Search Report and Written Opinion for App. No. PCT/EP2016/058788, dated Aug. 26, 2016, in 5 pages.
Swedish Office Action in App. No. 1550481-4, dated Dec. 4, 2015, in 5 pages.

* cited by examiner

APPARATUS AND METHOD FOR FILLING A PRODUCT INTO A CONTAINER

CROSS-REFERENCE TO RELATED APPLICATIONS

This application claims the benefit and priority to and is a U.S. National Phase of PCT International Application No. PCT/EP2016/058788, filed on Apr. 20, 2016. This application claims the benefit and priority to Swedish Patent Application No. 1550481-4, filed Apr. 22, 2015. The disclosure of the above-referenced applications are hereby expressly incorporated by reference in their entirety.

TECHNICAL FIELD

The present invention relates to the field of an apparatus and a method for filling a container with a product.

BACKGROUND

In the field of filling machines where a liquid product is to be filled into a container at a high fill rate it is a commonly known problem how to ensure the quickest possible filling of the container at the smallest amount of splashing, after-dripping or foaming. Especially in containers which are to be heat-sealed after the filling operation, trapped liquid drops or foam bubbles may compromise the seal integrity. These problems are exacerbated by high filling speeds and a large distance between the product surface and the end of the filling pipe.

In the food packaging industry, where liquid foodstuffs are to be filled into a container which is later to be sealed, the liquid foodstuffs are usually delivered through a filling pipe with a rubber nozzle at its end. In one variant, the open end of the container to be filled is aligned with the rubber nozzle and moved by a lifter mechanism towards the rubber nozzle, such that it enters the inside of the container. The lifter mechanism is programmed to stop the movement of the container at a certain predefined distance from its initial, or lowermost position. At this predefined distance, the liquid foodstuff is poured from the nozzle into the bottom end of the container and the lifter mechanism moves the container downwards back to its initial position while the liquid foodstuff is filled into the container. Shortly before the container has reached its initial position the flow from the rubber nozzle is stopped. After reaching the final position, the vertical movement of the lift mechanism and thus the container is stopped. Thereafter, the container is moved to the sealing part of the machine. In some other variants, the filling nozzle moves instead of the container during the filling cycle.

Now, in order to be able to fill packages at the specified machine capacity, it is very important that the product is poured out from the filling nozzle in a controlled way so that the distance between the rubber nozzle, that is mounted at the lower end of the filling pipe, and the product level inside the package is essentially constant and numerically correct during the time the lifter mechanism is lowering the package. Usually, the lifter mechanism is synchronized in some way with a filling pump delivering the liquid foodstuff through the rubber nozzle. The product level seen from the machine point of view shall be close to constant (in space) during at least half of the filling time i.e. up until the time point when the lifter mechanism de-synchronizes from the filling pump.

In some known filling machines, such as the example shown in FIG. 1A a container is lifted up by a container lifter from a bottom rail to its highest position, so that the distance between the lowest part of the rubber nozzles and the inside bottom of the package is correct when the pump starts to deliver the product.

There is usually a defined recommended distance between the inside container bottom and the lowest point of the rubber nozzle. When filling "tricky" products like Soy milk this distance may not be optimal, resulting in trapped air bubbles, product splash and foam. The problem with the mentioned effects is that product residues often will contaminate the transversal sealing zones of the containers causing bad container integrity.

Other examples of such filling machines are given in the U.S. Pat. Nos. 4,108,221 and 6,941,981.

There are many causes to a non-satisfactory filling performance. One of them is the timing difference between opening and closing of the inlet and the outlet valves, which valves are provided to control the discharge of the product into the container. If there for example is a valve overlap (i.e. both the inlet and the outlet valves are opened at the same time) at the end of a pump delivery stroke then severe after-dripping will occur coming from the inside of the rubber nozzle. This after-drip has a high probability to hit the transversal sealing zone during indexing of the containers, i.e. during the time the containers are moved from one station of the packaging apparatus (of which the filling apparatus is a part) to another. If the valve overlap is in the beginning of the pump delivery stroke then too much product may come out too fast resulting in splashing that might end up on the outside of the rubber nozzles. This product could/will later create undesirable after-dripping.

Another cause for after-dripping is that the product has been splashing up on the outside of the rubber nozzles some time during the filling. This can happen directly at the start of filling when the first product hits the bottom of the package. It is also possible that bad synchronization between the container lifter and cam profiles of an associated product pump can make the rubber nozzle dip down into the product and thereby making the outside of the rubber nozzles wet. At the end of the filling, when the carton lifter desynchronizes from the pump and moves down to the bottom rail, the product that is in contact with the outside of the rubber nozzle will drip.

A third reason for product splashing up on the outside of the rubber nozzle is the so called distance filling that occurs when the pump has started to decelerate and the carton lifter just continues its move down towards the bottom rail. During this "distance filling" the product surface may be very rough and stormy. It is worse when the distance between the lowest part of the rubber nozzle and the rough product surface is larger i.e. this distance should be minimized for as long as possible.

It is worth mentioning that it is not only in the filling station that product residues may contaminate the transversal sealing zone. Examples of other machine functions that may cause product residues in the top seal area are the package transport, the hot air heating of the top seal area and the squeezing of the gable top. If the product surface is rough at the end of the filling then it is very likely that the slosh wave that is created will make product touch the sealing zone, likewise if foam has been created due to trapped air or if the distance between the rubber nozzle and the product surface is too large during the major part of the filling, this foam will lay on top of the slosh wave or be blown up on the transversal seal zone by the top heater or be blown out at the start of the top squeezer close motion.

To eliminate foam and splashes it is very important to have a very short distance between the ideal product surface and the rubber nozzle during the major part of the filling. With current solutions it is extremely hard to optimize this. Although manually adjusting the times when the inlet and outlet valves open to achieve an improved filling result may work for some products, for others it may however only be possible to make the nozzle distance "good" either at the start of the filling or at the end but not both, whereby one of the undesired effects described above may occur. For an optimal filling cycle, it is desirable to keep the distance between the product level in the container and the end of the rubber nozzle essentially constant throughout the filling cycle.

SUMMARY OF THE INVENTION

One solution according to the present invention is accomplished by an apparatus for filling a product into a container. The apparatus comprises a filling unit configured for delivering the product into the container, the filling unit comprising a pump and furthermore a filling nozzle at its one end, a drive unit for moving the container in relation to the filling unit or vice versa, a control unit configured for controlling delivery of the product through the filling nozzle and the drive mechanism for moving the container, where the control unit is further configured to register when the drive unit has reached a first end position in relation to an end of the filling nozzle and to set the first end position as a new initial position for the drive unit in order to calculate a new drive unit position profile as a function of a pump position profile for the filling unit.

Since it is the distance between the product surface and the rubber nozzle during the filling of the package that is the most important attribute to get good filling performance i.e. minimize foam, splashes and after dripping, using the top most position of the carton lifter as a "virtual" origin point instead of using the bottom rail in the machine as the usual origin point the "bad" impact of all "vertical" manufacturing and mounting tolerances for the bottom rail, the carton lifter with its carton grippers, and the filling pipes may be eliminated.

In one embodiment of the method according to the present invention, the control unit calculates the drive unit position profile by comparing the new initial position for the drive unit with a current product volume delivered by a pump converted into length units. This the control unit may do at certain predefined time instances during the filling of the container.

The conversion may also be done by the control unit by calculating an actual product level in the container in relation to the new initial position of the drive unit by comparing the new initial position to a current product volume delivered by the pump converted into length units minus a constant multiplied by the converted volume squared and to calculate drive unit compensation distances as a function of the actual product level at each predefined position of the drive unit. In this way, undesirable effects on the product level in the container due to container bulging may be minimized.

Package bulging compensation on the container lifter profile makes it possible to accurately adjust the distance between the product level inside the package and the rubber nozzle without affecting any other part of the filling. This functionality significantly improves the end of the filling process.

According to another embodiment of the apparatus according to the present invention, the control unit may be further configured to calculate the speed of the pump at predefined positions of the drive unit and to calculate drive unit compensation distances as a function of the pump speed at each predefined position of the drive unit. In this way actual product levels lower than the theoretical product levels due to the interaction between the pump and the viscosity of the product in the pump housing of the filling apparatus may be compensated and the actual distance between the product level inside the container and the lower end of the filling nozzle may be minimized. The compensation may be done in the middle of the container filling cycle, since the effect becomes more pronounced around that time. Also worth mentioning is that the speed compensation makes the carton lifter to be "higher" up than what the theoretical pump and carton lifter position profiles requires when the pump speed increases.

According to yet another embodiment of the apparatus according to the present invention, the control unit may be configured to calculate the acceleration of the pump at predefined positions of the drive unit and to calculate drive unit compensation distances as a function of the pump acceleration at each predefined position of the drive unit. As a consequence, the control unit may instruct the drive unit to keep the container in the new initial position until the drive unit calculated position is less than the new initial position before moving the container away from the filling nozzle.

In this way, compensation of the actual lower product level in the container than predicted can be achieved at the beginning of the filling cycle. Usually, lower actual product levels at the beginning of the filling cycle are due to the pump cam taking time to accelerate and push the product out from the pump housing from a resting position.

According to yet another embodiment of the apparatus according to the present invention, the control unit is configured to instruct the pump to start to deliver a predefined volume of the product to the container before the container has reached its new initial position, wherein the predefined volume is less than the usual product volume delivered to the container when it has reached its new initial position. In this way, the product will hit the bottom of the container at exactly the time instant the drive unit has reached its topmost position. The effect of this is that the product will be spread out in an optimal way along the inside bottom of the container thereby preventing product splashing on the outside of the rubber nozzle. Another effect is reduced build-up of air bubbles which later may rise to the top of the container in the later stages of the filling cycle. Reduced build-up of air bubbles also means reduced risk of top seal integrity issue due to possible product entrapment in the top seal. The pre-fill move that can be adjustable both regarding start time and start volume. Pre-filling fills up the filling nozzle i.e. makes the filling nozzle expand and ensure that the product will start to leave the rubber nozzle when the carton lifter is at an optimal distance from its top position.

According to one other embodiment of the apparatus of the present invention, the filling unit comprises inlet and outlet valves and a pump housing, where the inlet and outlet valves are configured to regulate the volume of product delivered to the pump housing and the container respectively and wherein the control unit is configured to control the time instances at which the inlet and outlet valves open and close. In this fashion, correct synchronization between the inlet and outlet valves can be achieved for different machine speeds. One way of adjusting the valves is to adjust pneumatic restrictors on the inlet and the outlet valves, so that defined and constant move or motion times may be achieved. The valve move times are then used to automatically adjust the valve opening and closing timing points as a function of the current machine speed and thereby guaranteeing the correct opening and closing of the inlet and the outlet valves.

According to a first aspect an apparatus for filling a product into a container is provided. The apparatus comprises: a filling unit configured for delivering the product into the container, the filling unit comprising a pump and furthermore a filling nozzle at its one end; a drive unit for moving the container in relation to the filling unit or vice versa back and forth between a first position, in which a bottom end of the container is arranged at a maximum distance from the filling nozzle, and a second position, in which the bottom end of the container is arranged at a minimum distance from the filling nozzle, and a control unit configured to controlling delivery of the product through the filling nozzle, to control the drive unit, and to calculate a new drive unit motion profile for controlling movement from said second position to said first position. The control unit is further configured to calculate the acceleration of the pump at predefined positions of the drive unit, to calculate drive unit compensation distances as a function of the pump acceleration at predefined positions of the drive unit, and to update the drive unit motion profile using said drive unit compensation distances.

In an embodiment the control unit is further configured to calculate the new drive unit motion profile based on a current product volume delivered by the pump, said current product volume being converted into length units.

In an embodiment the control unit is configured to i) register an operational end position of the drive unit corresponding to said second position, ii) assigning the registered operational position as a new initial position for the drive unit, and iii) calculate said drive unit motion profile based on said new initial position.

In an embodiment the control unit is further configured to initiate delivery of the product through the filling nozzle before the drive unit reaches said operational end position.

In an embodiment the drive unit motion profile is calculated as a function of a pump motion profile.

In an embodiment the control unit is configured to updating the drive unit motion profile by comparing the new initial position for the drive unit with a current product volume delivered by the pump converted into length units at certain predefined instances during filling of the container.

In an embodiment the control unit is further configured to calculate an actual product level in the container in relation to the new initial position of the drive unit by comparing the new initial position to a current product volume delivered by the pump converted into length units minus a constant multiplied by the converted volume squared.

In an embodiment the control unit is further configured to calculate drive unit compensation distances as a function of the actual product level at predefined positions of the drive unit, and to update the drive unit motion profile using said drive unit compensation distances.

In an embodiment the control unit is further configured to calculate the speed of the pump at predefined positions of the drive unit, to calculate drive unit compensation distances as a function of the pump speed at predefined positions of the drive unit, and to update the drive unit motion profile using said drive unit compensation distances.

In an embodiment the control unit is configured to instruct the drive unit to keep the container in the new initial position until the calculated position for the drive unit is less than the new initial position before moving the container away from the filling nozzle.

In an embodiment the filling unit comprises inlet and outlet valves being configured to regulate the volume of product delivered into a fill volume and the volume of product delivered to the container respectively and wherein the control unit is configured to control the time instances at which the inlet and outlet valves open and close.

According to a second aspect a method for filling a product into a container is provided. The method comprises: controlling a drive unit for moving the container in relation to a filling unit or vice versa from a first position, in which a bottom end of the container is arranged at a maximum distance from a filling nozzle, to a second position, in which the bottom end of the container is arranged at a minimum distance from the filling nozzle; opening the one end of the filling unit and filling the product into the container; moving the container away from the end of the filling unit or vice versa by controlling the drive unit to step through a number of predefined positions according to a drive unit motion profile, while continuing to fill the product into the container; and closing the end of the filling unit, when the container has been moved to a predefined end position. The method further comprises calculating the acceleration of the pump at predefined positions of the drive unit in order to obtain drive unit compensation distances as a function of the pump acceleration at each predefined position of the drive unit.

In an embodiment the method further comprises calculating a new drive unit motion profile for controlling movement from said second position to said first position based on a current product volume delivered by the pump, said current product volume being converted into length units.

Delivery of the product through the filling nozzle may be initiated before the drive unit is controlled to move the container away from the end of the filling unit or vice versa.

In an embodiment the method further comprises registering an operational end position of the drive unit corresponding to said second position as a new initial position; wherein said predefined positions of the drive unit during filling of the container are recalculated in relation to the new initial position.

In an embodiment the method further comprises calculating a motion profile for the drive unit by comparing the new initial position for the drive unit with a current product volume delivered by the pump converted into length units.

In an embodiment the method further comprises calculating an actual product level in the container in relation to the new initial position of the drive unit by comparing the new initial position to a current product volume delivered by a pump of the filling unit converted into length units minus a constant multiplied by the converted volume squared.

In an embodiment the method further comprises calculating the speed of the pump at predefined positions of the drive unit, calculating drive unit compensation distances as a function of the pump speed at predefined positions of the drive unit, and updating the drive unit motion profile using said drive unit compensation distances.

In an embodiment the method further comprises controlling a volume of the product delivered into a fill volume of the filling system and the volume of product delivered to the container respectively by controlling the movement of inlet and outlet valves in the filling unit.

According to a third aspect a computer program product for an apparatus for filling a product into a container is provided. The computer program product comprises instruction sets for: controlling a drive unit for moving the container in relation to a filling unit or vice versa from a first position, in which a bottom end of the container is arranged at a maximum distance from a filling nozzle, to a second position, in which the bottom end of the container is arranged at a minimum distance from the filling nozzle; opening the one end of the filling unit and filling the product into the container; moving the container away from the end of the filling unit or vice versa by controlling the drive unit to step through a number of predefined positions, while continuing to fill the product into the container; and closing the end of the filling unit, when the container has been moved to a predefined end position. The computer program product further comprises instructions sets for calculating the acceleration of the pump at predefined positions of the drive unit in order to obtain drive unit compensation distances as a function of the pump acceleration at each predefined position of the drive unit.

DETAILED DESCRIPTION

In the ensuing pages several example embodiments of the present invention are presented. These examples should not be construed as limiting the present invention, but to be understood as being for illustration purposes only.

Figure 1A:
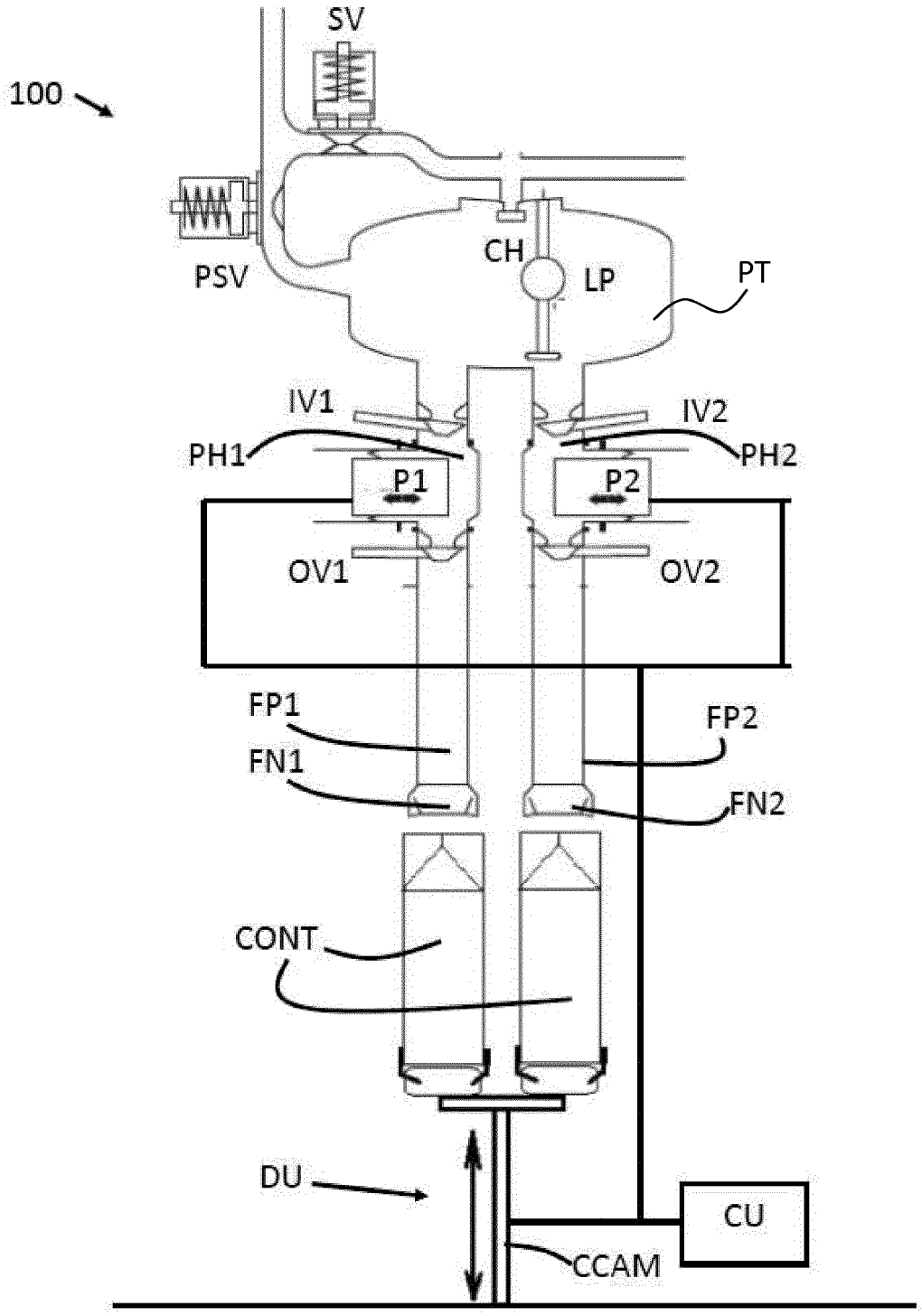
FIG. 1A displays an apparatus for filling of packaging containers according to an embodiment in a first position.

FIG. 1A displays an apparatus 100 for filling a container, which in this case is a packaging container CONT made of carton. In FIG. 1A the containers CONT are in a bottom position, where they just arrived from a previous processing step, which may be a sterilization of the container. The containers CONT are located on a bottom rail. Also, as can be seen from FIG. 1A, the upper open end of the containers is aligned with the lower end of the filling nozzles FN1, FN2 belonging to the filling apparatus 100. The mechanism for moving the containers is a drive unit DU in the form of a container lifter having a cam CCAM movable in a vertical direction indicated by the double arrows.

The filling apparatus 100 comprises a product supply valve PSV which regulates the flow of the product (not shown) to be filled in the containers CONT into the product tank PT. Moreover, a spray valve SV, located above the tank PT is used to regulate the supply of cleaning liquid for cleaning the product tank PT, the pump housings PH1, PH2, filling pipes FP1, FP2 and filling nozzles FN1, FN2 belonging to the filling apparatus 100. This cleaning fluid is delivered through the cleaning head CH located in the upper portion of the product tank PT.

Moreover, the filling apparatus 100 comprises means for detecting the product level in the tank PT by means of a level probe LP, which is floating on top of an imagined product level.

In order to safeguard a controlled product flow from the filling nozzles FN1, FN2 *s* into the containers CONT a set of inlet and outlet valves IV1, IV2 and OV1, OV2 are arranged in the filling pipes FP1, FP2. Each filling pipe FP1, FP2 is associated with one inlet valve IV1, IV2 and one outlet valve OV1, OV2. Further, each filling pipe FP1, FP2 is associated with a corresponding pump P1, P2.

In the present figure, the inlet valves IV1, IV2 of the respective pump housings PH1, PH2 are open allowing the product to enter the pump housings PH1, PH2 at a certain rate depending on the inlet valve opening. In this position, the outlet valves OV1, OV2 are closed and will remain closed until the container lifter DU has moved the containers CONT to a specified height corresponding to the upper end position.

Figure 1B:
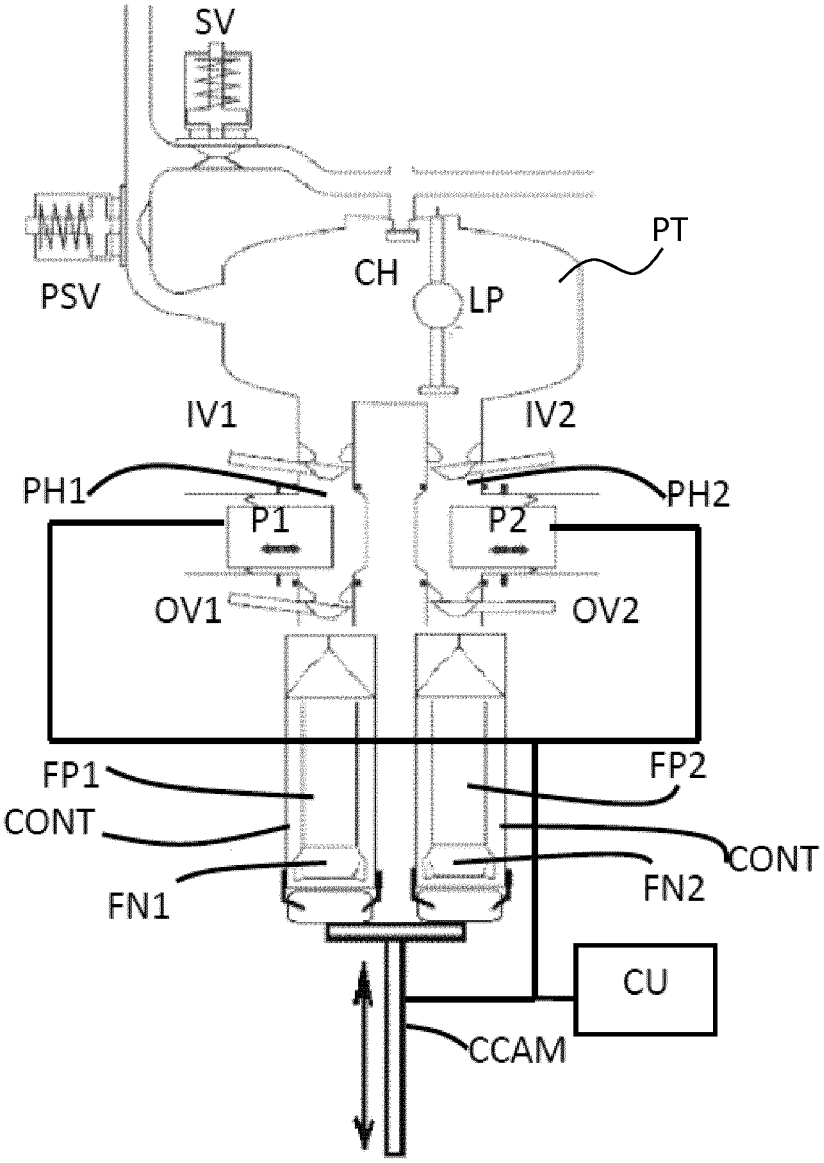
FIG. 1B displays the same apparatus in a second position.

In FIG. 1B a situation is presented where the container lifter DU is in its topmost position where the filling nozzles FN1, FN2 have entered the respective container interior and they are located at a short distance away from, and vertically above, the container bottom. Usually, the filling cycle starts when the container lifter DU has reached its topmost position. Thus, at the beginning of the filling cycle starting when the container lifter DU has reached the top most position, the pumps P1, P2 start pumping the product out of pump housing PH1, PH2 through the filling pipes FP1, FP2 and through the filling nozzles FN1, FN2 into the containers CONT. In the next step, the container lifter DU moves the containers CONT downward while the product is still delivered from the filling nozzles FN1, FN2. Usually, the delivery of the product through the nozzles FN1, FN2 stops shortly before the container lifter DU has reached its first initial position, i.e. when it has reached the level of the bottom rail, the bottom rail being the rail on which the containers are transported towards and past the filling apparatus. During this second part of the container lifter DU movement, i.e. from the moment of reaching its topmost position until at least the end of the filling process shortly before the container lifter DU has reached the bottom rail, the movement of the container lifter cam CCAM and the pump cam (not shown) are synchronized. The reason for this is to achieve a more or less constant distance between the product level in the containers CONT and the lower end of the filling nozzles FN1, FN2 during the movement of the containers CONT away from the filling nozzles FN1, FN2 and towards the bottom rail—at least in theory.

However, as explained earlier, at high filling speeds, i.e. at speeds where several thousand containers per hour are filled, such a set-up of the filling apparatus may result in unwanted splashing, after dripping and foaming which may affect the seal integrity of the filled containers.

The present invention aims at alleviating at least some of these problems and allowing for the filling apparatus to operate at higher speeds being even higher than established operating speeds. For this a control unit CU is provided which is configured to control the delivery of the product through the filling nozzles FN1, FN2, and to control the drive unit DU. Further, the control unit CU is configured to register when the drive unit DU has reached a first end position in relation to an end of the filling nozzle(s) FN1, FN2 and to set the first end position as a new initial position for the drive unit DU in order to calculate a new drive unit position profile as a function a pump position profile for the filling unit. In other words, the control unit CU is configured to i) register an operational end position of the drive unit DU corresponding to a position in which the bottom end of the container CONT is arranged at a minimum vertical distance from the filling nozzle FN1, FN2, ii) assigning the registered operational position as a new initial position for the drive unit DU, and iii) calculating a new drive unit motion profile for controlling movement from said position to a position in which a bottom end of the container CONT is arranged at a maximum distance from the filling nozzle FN1, FN2 based on said new initial position.

Figure 2:
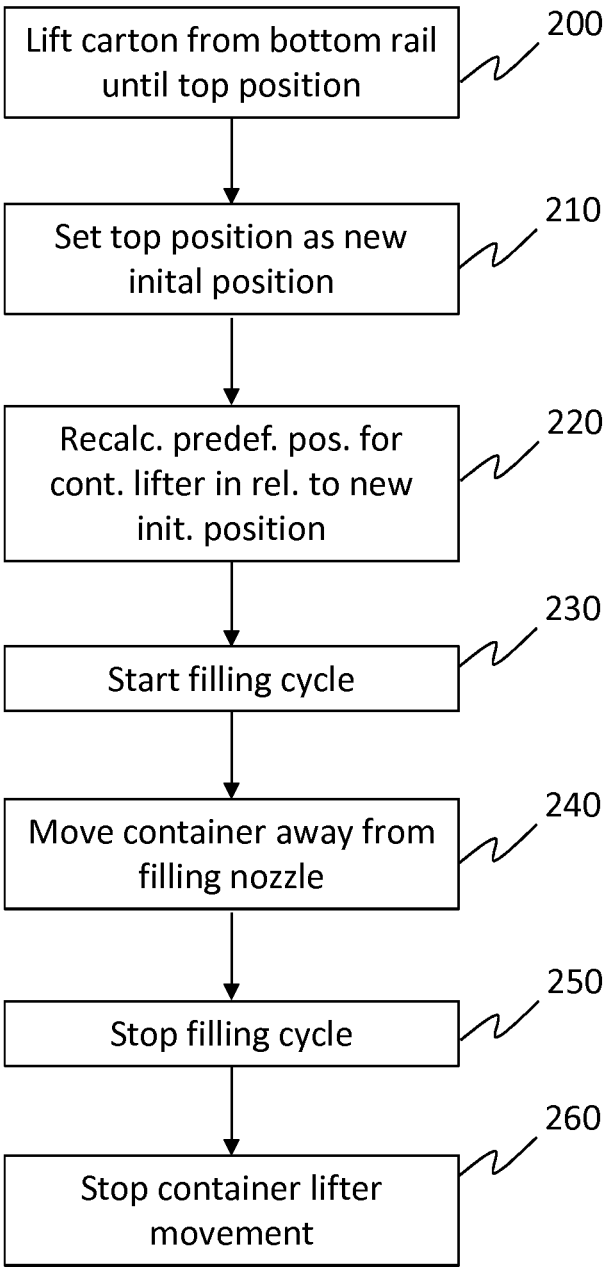
FIG. 2 displays a flow chart of the method according to a first embodiment of the present invention.

FIG. 2 illustrates a flow chart representing a first embodiment of the present invention. This example is assumed to be realized by the operation of the filling apparatus 100 from FIGS. 1A and 1B. However, it should be mentioned that the principles of the method according to this and other embodiments of the method according to the present invention are applicable to any filling system where vertical filling is performed and where an open end of the filled container needs to be sealed in some way.

Now, at step 200 a drive unit, such as the container lifter form FIG. 1A, lifts the container from a bottom rail upward towards a lower end of the filling nozzle in the filling apparatus to its topmost position where the drive unit stops further movement. The topmost position for the drive unit is preferably already predefined. In the topmost position, the filling nozzle has entered the interior of the container and is located at a short or minimum distance from the container bottom. It should be clarified here, that by container bottom, the closed side of the container is meant, which may not be the "actual" container bottom, especially in cases where the container to be filled is turned upside down.

At step 210 the control unit CU of the filling apparatus sets the new top position of the container lifting unit as its new initial position. Since the distance between the product surface and the filling nozzle during the filling of the container has a significant influence on obtaining good filling performance i.e. minimized foam building, splashes and after dripping, the top most position of the carton lifter is selected as a "virtual" origin point instead of the usual case where the bottom rail in the filing machine is the normal origin point for the container lifter. By doing this the negative impact of all "vertical" manufacturing and mounting tolerances for the bottom rail, the carton lifter with its carton grippers, and the filling pipes is eliminated.

At step 220, the control unit CU recalculates a new drive unit motion profile, for example by recalculating predefined points on the container lifter position cam profile using this new topmost position as an origin point or a new initial position of the container lifter. The container lifter position cam definition points are preferably based on its topmost position and the delivery motion of the pump during the filling. One variant of the recalculation is to take the new initial position of the container lifter and then deduct the current volume delivered by the filling pump converted into length units for the carton lifter. The length units may for example be millimetres.

Next, at step 230, the control unit CU initiates the filling cycle by instructing the pump to start delivering the product into the container and the container lifter cam to follow the recalculated container lifter cam position profile.

At step 240, the container lifter moves the container away from the end of the filling nozzle towards the bottom rail again all the while the product is still delivered to the container.

At step 250, when the container lifter has almost reached the bottom rail, product delivery from the pump to the container is stopped and the filling cycle for the container has ended.

Finally, at step 260 the container lifter stops its movement away from the filling nozzle when it has reached the bottom rail.

The container will subsequently be forwarded to a sealing and folding station for further processing (not shown).

Thus the first embodiment of the method according to the present invention is to control the distance between the product surface and the filling nozzle during the filling by letting the control unit calculate the ideal container lifter position profile, or motion profile, during filling as a function of the pump cam position profile. Assuming that the product is fully compressible without build-up of foam and small air bubbles, that there is no elasticity (elastic components) in the filling apparatus, and that the cross section of the package is constant, the above compensation method works very well.

Figure 3:
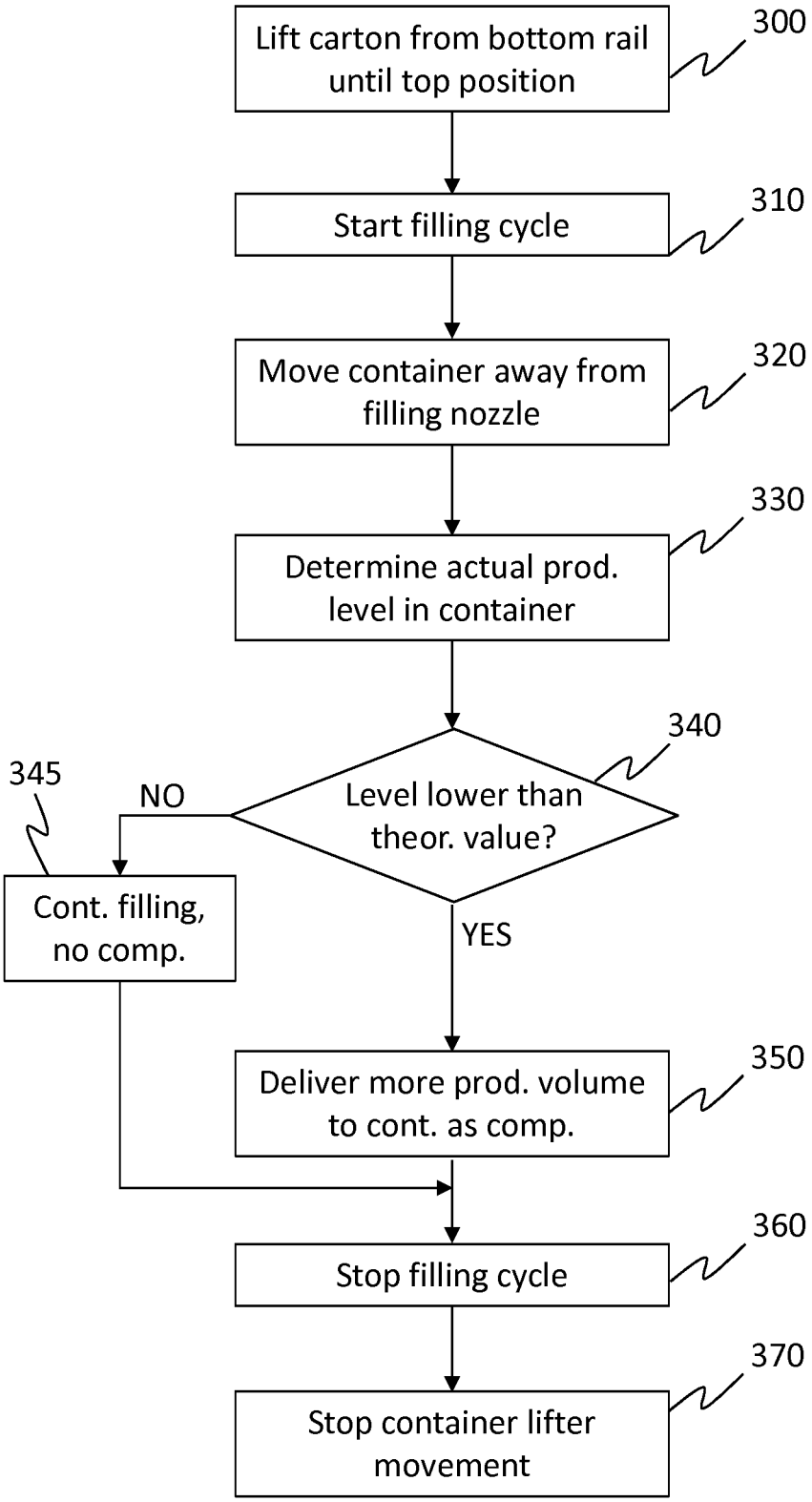
FIG. 3 displays a flow chart of the method according to a second embodiment of the present invention.

FIG. 3 illustrates a second embodiment of the method according to the present invention, where the filling performance may be further improved.

It has namely been discovered by the applicant, that in certain cases the embodiment of the invention according to FIG. 2 resulted in that container lifter moved downward too early or too fast and that the distance between the lower end of the rubber nozzle and the product surface was increasing during the filling.

Searching for a root cause for this behaviour yielded that it was caused by package bulging during filling. Package bulging can be explained as a package cross section change from the ideal square format, being typically either 70×70 mm or 91×91 mm, to something more round. Rounder cross section means that the cross sectional area is increasing and that in turn means that the product level inside the package will be lower than what the theoretical pump and carton lifter position values would give.

Measurements of the real/actual product height inside the package were made on 750 ml, 1000 ml and 1750 ml Tetra Rex Cartons to see how much they bulged at different product levels. For a 1000 ml, 70×70 mm in cross section package filled with water the final product level was about 15 mm lower than the theoretical product level. For the 1750 ml, 91×91 mm cross section package the final product level difference was about 13 mm. The bulging measurements were made static i.e. the packages were standing still on a horizontal surface i.e. there were no dynamic effects at all like a pump pressing product down into the package.

Returning to the second embodiment of the method according to the present invention, the drive unit in the form of a container lifter, similar to the embodiment in FIG. 2, moves at step 300 the container from the bottom rail to its topmost position where the drive unit stops.

At step 310 the filling cycle is started, i.e. the pump starts delivering the product to the container through the filling nozzle.

At step 320 the container lifter moves the container away from the filling nozzle and down towards the bottom rail.

At step 330 the control unit CU calculates the current product level in the container and compares it to a theoretical value. The calculation of the actual product level in the container may be done according to an equation where it assumed that the actual product level inside the package is equal to the ideal level i.e. how many millilitres of product that the pump has delivered converted to millimetres minus a "constant" multiplied with the delivered volume in square. This calculated product level values according to this equation has been shown to deviate very little from the theoretical product level inside the package in the beginning of the filling but later when the product level is getting higher the impact will be larger. Also, the amount of bulging is dependent on the area of the bottom surface of the container, where containers with larger bottom areas are more prone to bulging than those with reduced bottom areas.

Now, if at step 340 the control unit CU detects that the current product level is lower than the theoretical value this is a sign of container bulging, i.e. the packaging material of the container bulges outward thus effectively lowering the product level in the container below the theoretical value. In this case, the control unit instructs the pump at step 350 to increase the delivery of the product volume to the container to compensate for container bulging. Running tests with bulging compensation on the carton lifter profile showed that it was now possible to adjust the nozzle to product level distance in the end of the filling without making a change in the beginning.

If no discrepancy between the actual product level and the theoretical product level is detected, the filling cycle continues as usual at step 345 until it stops at step 360 shortly before the drive unit has reached the bottom rail.

At step 370, when the drive unit has reached the bottom rail, the drive unit stops further movement.

Even using the filling method with the compensation techniques described in Fig., it may be possible in some cases to encounter a problem where the pump and the container lifter do not follow each other, even though they ought to, if only the actual positions of the pump and the lifter were taken into account. The result of such loss of synchronisation between the pump and the container lifter may then result in that the product level inside the package is lower than it should be according to theoretical calculations.

Figure 4:
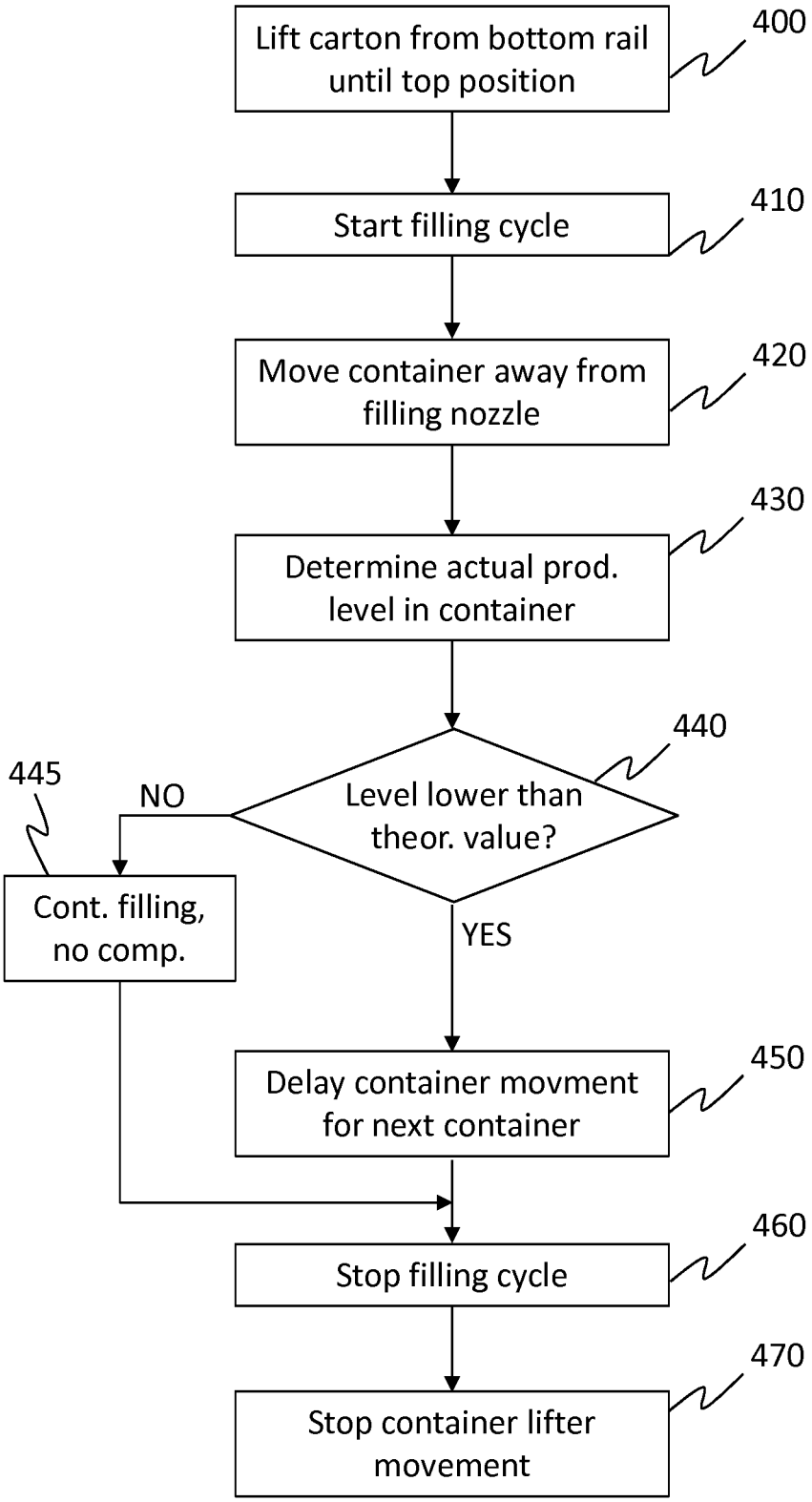
FIG. 4 displays a flow chart of the method according to a third embodiment of the present invention.

FIG. 4 shows a third embodiment of the method according to the present invention addressing this problem.

In the embodiment in FIG. 4 steps 400-430 are identical to steps 300-330 in FIG. 3 and will therefore not be repeated.

At step 440, thus after the container lifter has started moving the container away from the filling nozzle and towards the bottom rail, the control unit CU determines the actual product level in the container. If the actual product level at step 440 is detected to be lower than the theoretical product level at the beginning of the filling cycle, then there is likely a spring effect in the interaction between the pump and the product that is delivered to the container. A possible spring effect is related to pump acceleration which can be compensated by the movement of the container lifter.

At step 450 the control unit CU stores information in a memory, such that the subsequent container should be held in its topmost position for a longer period of time thereby compensating for the pump acceleration effect.

However, if at step 445 no deviation is detected, the filling cycle continues unabated at step 445 until is stopped at step 460 shortly before the container lifter reaches the bottom rail.

At step 470 the movement of the container lifter is stopped when it has reached the bottom rail.

Figure 5:
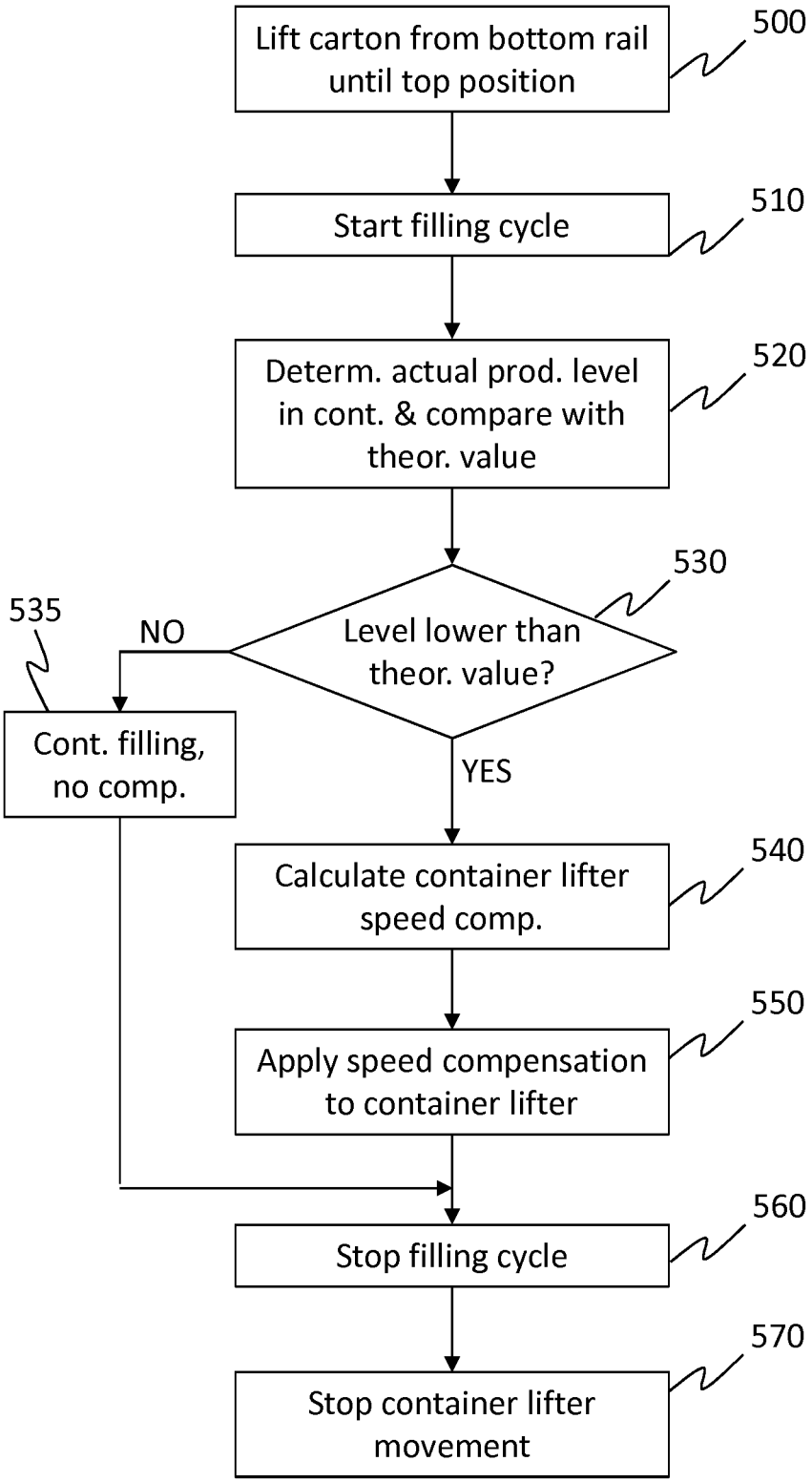
FIG. 5 displays a flow chart of the method according to a fourth embodiment of the present invention.

FIG. 5 illustrates another embodiment of the method according to the present invention, where steps 500-535 are identical to steps 400-445 in the previous embodiment shown in FIG. 4.

Now, if at step 530 it is determined that the actual product level is below the expected theoretical value and the determination has been made close to the middle of the filling cycle, this deviation may be due to the interaction of the pump cam pushing the product out of the fill volume and the viscosity of the product itself.

In this case, the control unit CU calculates at step 540 a compensation value for the container lifter and then slows down the downward movement of the container lifter accordingly. What the control unit CU in essence does is to calculate speed values for the pump cam at certain predefined positions along the pump cam position curve and compares this value to theoretical values of the same curve. Then, at these predefined positions, the control unit CU calculates container lifter compensation distances at corresponding predefined position on the container lifter cam position curve. The compensation is simply a scale factor which when applied to the container cam lifter, results in slowing down of the movement of the same.

After the compensation factor is applied to the container lifter cam at step 550 temporarily slowing it down, the filling cycle is stopped at step 560 shortly before the container lifter reaches the bottom rail.

Finally, at step 570, the container lifter movement is stopped when it has reached the bottom rail.

Figure 6:
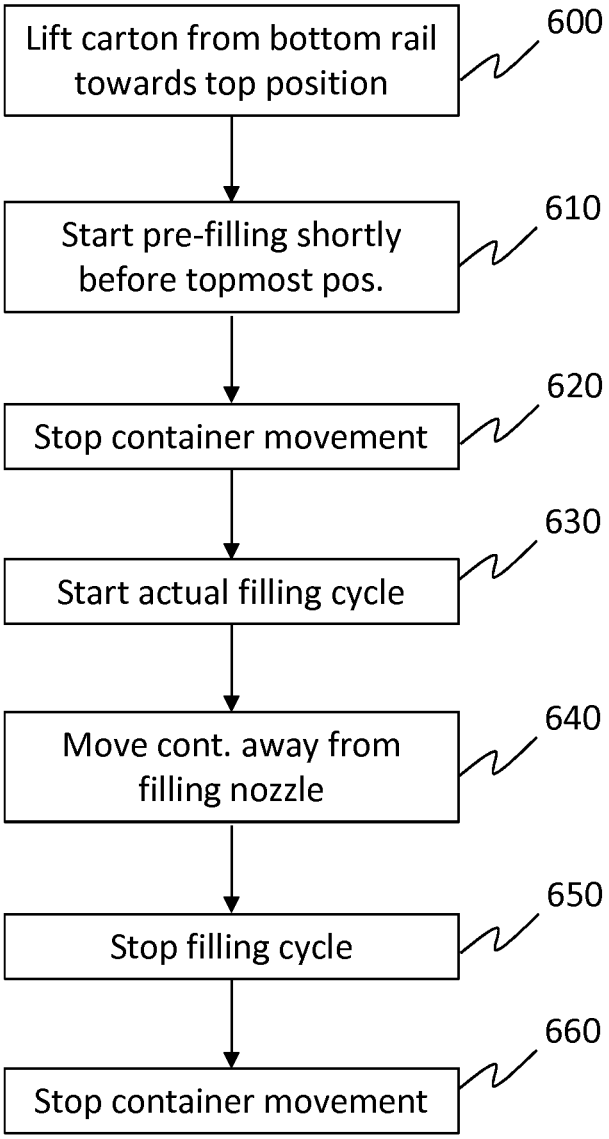
FIG. 6 displays a flow chart of the method according to a fifth embodiment of the present invention.

FIG. 6 presents yet another embodiment of the method according to the present invention addressing the following problem. In order to avoid air entrapment in the product at the start of the filling cycle, it is very important that the correct amount of product leaves the rubber nozzle in exactly the right time to fill up the inside package bottom surface. The ideal situation is that the first product that comes out from the rubber nozzles touches the inside bottom of the package exactly at the time when the carton lifter reaches its topmost position.

Now, at step 600 the container lifter moves the container from the bottom rail towards the filling nozzle of the filling apparatus. Thereafter, at step 610, the control unit CU instructs the pump to release a small volume of the product into the container, i.e. a so called pre-fill volume shortly before the container lifter has reached its topmost position. One may generally define the term "shortly before the topmost position" as a predefined time instant before the time instant where the container lifter has reached its topmost position. Such a pre-fill volume can be commanded to start to fill a number of milliseconds before the normal pump cam starts, which is at exactly the same time as the carton lifter reach its topmost position. Both the volume of the pre-fill and the time when it shall start may be adjusted by the operator. The effect of the pump pre-fill move is to get a stabile product surface early at start of filling and thereby avoid trapping air under the product surface. If air bubbles are trapped under the product surface then they will cause a lot of disturbances during the rest of the filling.

The first disturbance of trapped air bubbles is that they will have a volume. This volume will cause the product level to be higher up closer to the rubber nozzle or even make the rubber nozzle dip into the product. The second disturbance of trapped air bubbles is that when they break at the product surface the result will be a rough and stormy surface. When these two disturbance effects happen at the same time i.e. the product surface is closer to or even touching the rubber nozzle and bubbles that are breaking the surface create rough waves then it is very likely that product start to crawl up on the outside of the rubber nozzle. This crawling product may even wet the transversal sealing zone when it passes the lower part of the rubber nozzle or create after drips that may wet the transversal sealing during indexing of the package.

Now, when the container lifter has reached its topmost position further movement is stopped at step 620.

Thereafter, the normal filling cycle for the container starts at step 630 as in any of the embodiments described earlier.

At step 640 the container lifter moves the container downwards away from the filling nozzle towards the bottom rail, while the pump stops the filling cycle at step 650 shortly before the container lifter has reached its bottommost position at the bottom rail.

Finally, at step 660, the container lifter stops further movement once it has reached the bottom rail.

Figure 7:
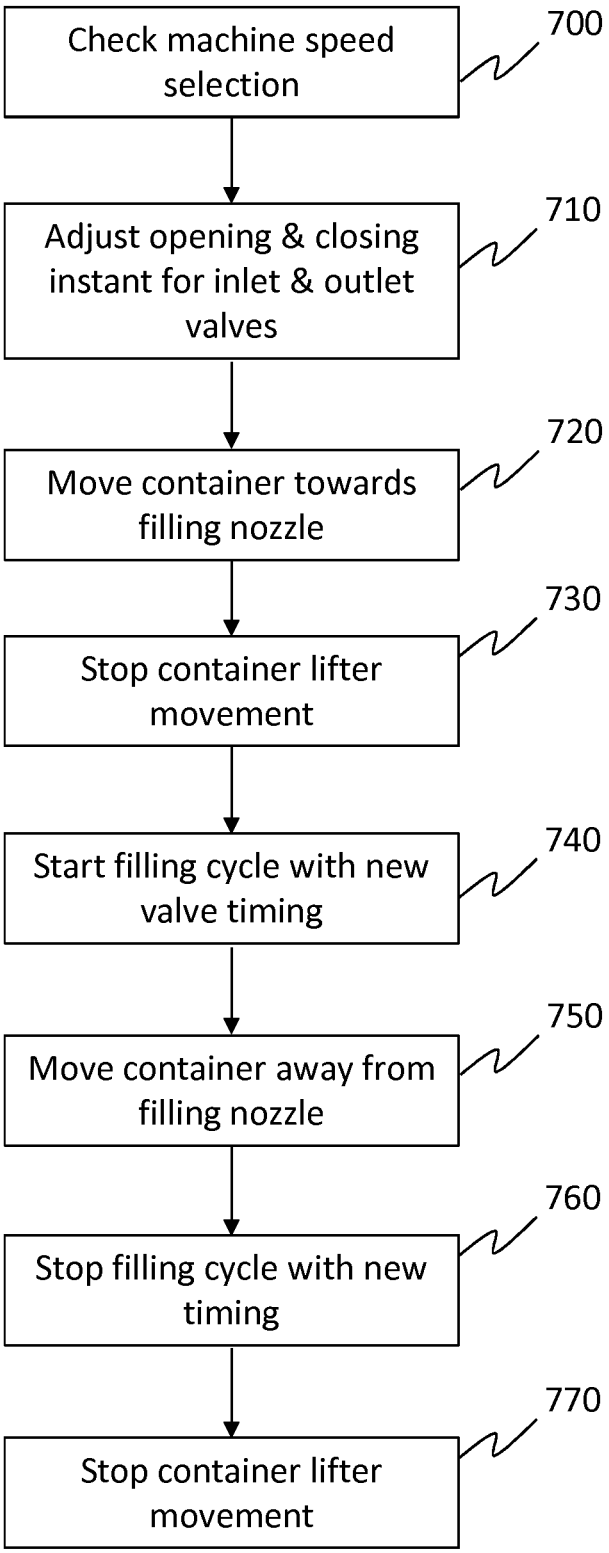
FIG. 7 displays a flow chart of the method according to a sixth embodiment of the present invention.

FIG. 7 displays yet another embodiment of the method according to the present invention.

At step 710, the control unit CU checks the machine speed selected by the operator. The reason for this is that a synchronisation for inlet and outlet valves for one machine speed may not guarantee that the valves stay in synch for other machine speeds.

The timing of the opening and the closing of the inlet and the outlet valves is very critical for a satisfactory filling cycle. A valve overlap must be avoided, since there is then an increased risk of an uncontrolled flow of product.

The inlet and outlet valves are driven by pneumatic air cylinders. The move or motion times of these cylinders are mainly dependent of the pneumatic pressure and the flow restrictors that are mounted on the cylinders. In reality this means that the move times are more or less constant for a certain pneumatic air pressure and for a specific restrictor setting. As one example a filling apparatus may be set to produce either 5000, 5500, 6000, 6500 or 7000 packages per hour. This means that the actual opening and closing time points needs to be changed in order to get the correct synchronisation of the inlet and the outlet valves together with the pump profiles for all production speeds.

Thus, at step 710 the control unit CU uses an algorithm to calculate the time instants for opening and closing of the inlet and outlet valves and adjust the time instants accordingly in the filling apparatus. In this way, the inlet and outlet valve synchronisation becomes independent of the current machine speed.

At step 720 the container lifter starts the upward movement of the container towards the filling nozzle and stops at step 730 when it has reached its topmost position.

Thereafter, the filling cycle starts at step 740, but with the updated input and output valve closing and opening time instants.

Next, at step 750, the container lifter moves the container away from the filling nozzle in the direction of the bottom rail while the product is still being filled into the container.

At step 760, the filling cycle is terminated by stopping further delivery of the product into the container, but using the updated outlet valve closing instants.

Finally, at step 770, the container lifter reaches the bottom rail and further container lifter movement is stopped.

Figure 8:
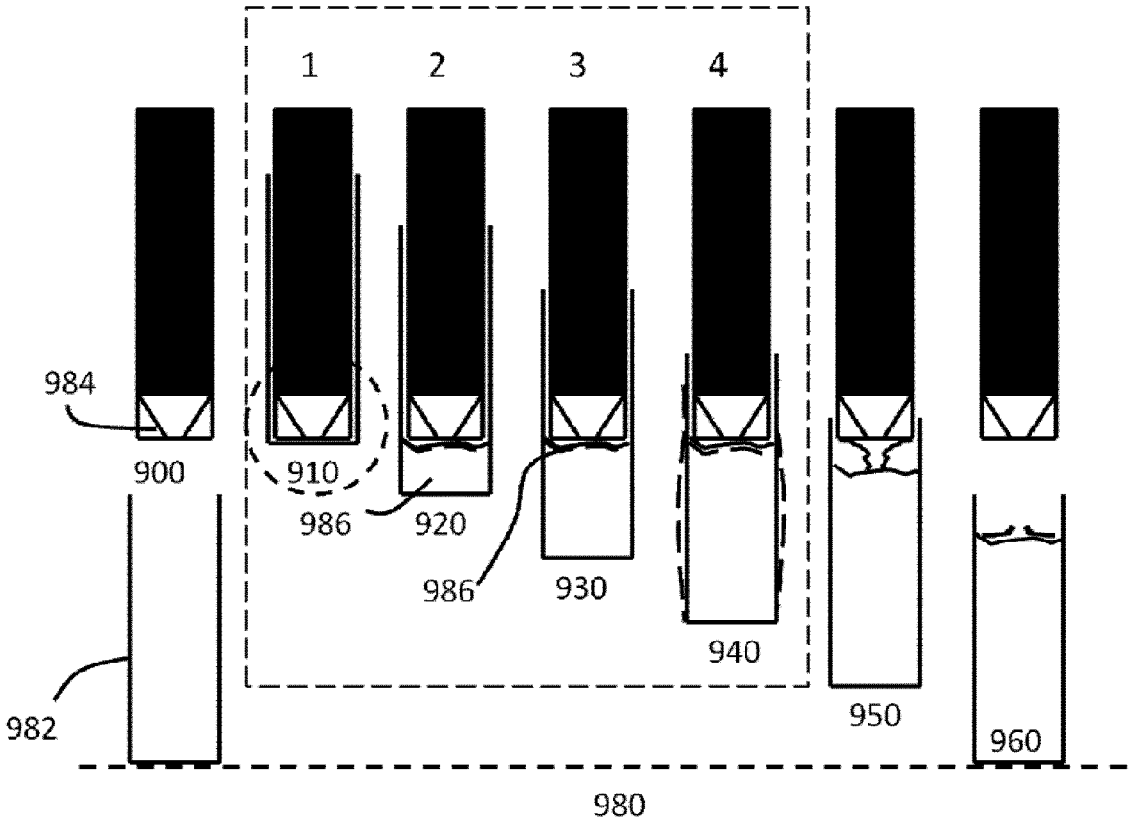
FIG. 8 displays a diagram illustrating one cycle of the filling process for a container in an example filling apparatus using the method according to the embodiments illustrated in FIGS. 2-7.

FIG. 8 describes a new filling cycle using many of the compensation methods described earlier in order to obtain an optimum filling cycle.

Firstly, the container lifter (not shown) with a container 982 loaded onto it is located at the bottom rail. Then, the process starts at 900 when the container lifter moves the container towards the filling nozzle 984 of the filling apparatus and towards a topmost position. In order to avoid trapped air bubbles which later in the filling cycle may rise to the top of the container and potentially compromise seal integrity, a small product volume is released from the filling nozzle, such that the product reaches the bottom of the container at exactly the time instant when the carton lifter has reached its topmost position. In other words, a pre-fill volume is released from the filling nozzle 984 at step 910 a couple of milliseconds before the container lifter has reached its topmost position, which is described in the embodiment in FIG. 6. Such compensation may be called a step 1 filling optimization.

Thereafter, the "real" filling cycle starts at step 920. Since at this stage, the product surface 920 may be lower than the theoretical value and is most probably caused by the acceleration of the pump cam interacting with the product in the fill volume, the control unit CU instructs the container lifter to stay in its topmost position a predefined period of time. The predefined amount of time can be calculated from the pump cam position profile curve and translated into the number of milliseconds during which the container lifter stays in its topmost position. One may call such compensation a step 2 filling optimization.

Once the container lifter starts moving the container downward at step 930, the control unit CU may instruct the container lifter to slow down its movement in order to compensate for the interaction of the pump speed with the viscosity of the product. This compensation may then be called a step 3 filling optimization.

Towards the end of the filling cycle, the cross-sectional area of the container together with the weight of the product in it may cause bulging of the container leading to a reduced product level compared to the theoretical product level. The control unit CU may then instruct the pump towards the end of the filling cycle at step 940 to increase the product volume delivered to the container to compensate for bulging. This compensation may be called step 4 filling optimization.

Finally, at the end of the filling cycle the pump stops delivering the product to the container at step 950 and shortly thereafter, the container lifter has reached the bottom rail again at step 960.

To summarize the above optimization steps, one can generally say that if the distance between the lowest part of the rubber nozzle and the product surface is getting large immediately after the start of filling then the acceleration compensation should be increased. There is simply some kind of force (acceleration towards the end pump cam position) related elasticity that phase shifts the actual product that leaves the rubber nozzle from the motion of the pump piston.

If the distance between the lowest part of the rubber nozzle and the product surface is increasing in the middle of the filling when the acceleration changes to a deceleration it is the speed compensation that should be changed. It is then some kind of speed dependent viscous effect or dynamic bulging of the package that causes the product level inside the package to be lower than it ought to be.

Then later if the distance between the lowest part of the rubber nozzle and the product surface becomes larger close to the end of the filling then it is the package bulge compensation that should be used.

It should also be mentioned that parameters for all of the compensation methods described in FIGS. 2-7 may be selected by an operator on a control panel. Moreover, some or all of the parameters are affected by the type of product to be filled into the container, the container size and especially its bottom surface area and the machine speed.

A predefined set of values for pre-fill compensation, pump cam speed and acceleration compensation and bulging may be already stored in the memory of the filling apparatus for a number of products, container sizes and machine speeds. Thus, an operator may simply select these known values and the control unit CU may then select the corresponding parameters for pre-fill compensation, speed and acceleration compensation and bulging.

Using a control panel, the operator may then fine-tune the compensation values to achieve an optimum filling process.

Also, for the purpose of understanding the movement of the product in the container, a number of window-containers may be used (window-containers meaning containers with one transparent side). Observing the behaviour of the liquid and the level variations of the product level in the container during the filling cycle, an operator can decide which type of compensation technique to use or to combine several compensation methods.

As already mentioned earlier, compensation parameters will vary from product to product, from machine to machine and from packaging size to packaging size. Hence, a test run for each new configuration needs to be made before the correct compensation parameters and technique can be used.

In the description above a number of different methods for adjusting a filling operation has been described. These methods are all based on the general concept of achieving a desired position of the product level inside the container relative the filling nozzle throughout the downward movement of the container during the filling operation. By compensating for one or more undesired effects a more accurate control of the filling operation is achieved. These undesired effects may e.g. relate to i) entrapped air bubbles during the initial phase of the filling cycle, ii) bulging of the container, iii) variations of the pump speed due to product viscosity, or iv) variations of the pump acceleration due to the interaction between moveable parts of the pump and the product.

The invention claimed is:

1. An apparatus for filling a product into a container, the apparatus comprising:

a filling unit configured to deliver the product into the container, the filling unit comprising a pump and a filling nozzle at its one end;

a drive unit configured to move the container in relation to the filling unit between a first position, in which a bottom end of the container is arranged at a maximum distance from the filling nozzle, and a second position, in which the bottom end of the container is arranged at a minimum distance from the filling nozzle; and a controller configured to:

control delivery of the product through the filling nozzle;

control the drive unit;

calculate a new drive unit motion profile for controlling movement from said second position to said first position;

calculate an acceleration of the pump at predefined positions of the drive unit;

calculate drive unit compensation distances as a function of the pump acceleration at the predefined positions of the drive unit; and update the drive unit motion profile using said drive unit compensation distances.

2. The apparatus according to claim 1, wherein the controller is further configured to calculate the new drive unit motion profile based on a current product volume delivered by the pump, said current product volume being converted into length units.

3. The apparatus according to claim 1, wherein the controller is further configured to i) register an operational end position of the drive unit corresponding to said second position, ii) assign the registered operational position as a new initial position for the drive unit, and iii) calculate said drive unit motion profile based on said new initial position.

4. The apparatus according to claim 3, wherein the controller is further configured to initiate delivery of the product through the filling nozzle before the drive unit reaches said operational end position.

5. The apparatus according to claim 1, wherein said drive unit motion profile is calculated as a function of a pump motion profile.

6. The apparatus according to claim 3, wherein the controller is further configured to update the drive unit motion profile by comparing the new initial position for the drive unit with a current product volume delivered by the pump converted into length units at certain predefined instances during filling of the container.

7. The apparatus according to claim 3, wherein the controller is further configured to calculate an actual product level in the container in relation to the new initial position of the drive unit by comparing the new initial position to a current product volume delivered by the pump converted into length units minus a constant multiplied by the converted volume squared.

8. The apparatus according to claim 7, wherein the controller is further configured to calculate drive unit compensation distances as a function of the actual product level at predefined positions of the drive unit, and to update the drive unit motion profile using said drive unit compensation distances.

9. The apparatus according to claim 1, wherein the controller is further configured to calculate a speed of the pump at predefined positions of the drive unit, to calculate drive unit compensation distances as a function of the pump speed at the predefined positions of the drive unit, and to update the drive unit motion profile using said drive unit compensation distances.

10. The apparatus according to claim 3, wherein the controller is further configured to instruct the drive unit to keep the container in the new initial position until a calculated position for the drive unit is less than the new initial position before moving the container away from the filling nozzle.

11. The apparatus according to claim 1, wherein the filling unit comprises inlet and outlet valves configured to regulate a volume of product delivered into a fill volume and a volume of product delivered to the container respectively and wherein the controller is configured to control time instances at which the inlet and outlet valves open and close.

12. A method for filling a product into a container, the method comprising:

controlling a drive unit for moving the container in relation to a filling unit from a first position, in which a bottom end of the container is arranged at a maximum distance from a filling nozzle, to a second position, in which the bottom end of the container is arranged at a minimum distance from the filling nozzle;

opening a first end of the filling unit and filling the product into the container; moving the container away from the first end of the filling unit by controlling the drive unit to step through a number of predefined positions according to a drive unit motion profile while continuing to fill the product into the container;

closing the first end of the filling unit when the container has been moved to a predefined end position; and calculating an acceleration of a pump of the filling unit at predefined positions of the drive unit in order to obtain drive unit compensation distances as a function of the pump acceleration at each predefined position of the drive unit.

13. The method according to claim 12, further comprising calculating a new drive unit motion profile for controlling movement from said second position to said first position based on a current product volume delivered by the pump, said current product volume being converted into length units.

14. The method according to claim 13, wherein delivery of the product through the filling nozzle is initiated before the drive unit is controlled to move the container away from the first end of the filling unit or vice versa.

15. The method according to claim 12, further comprising:

registering an operational end position of the drive unit corresponding to said second position as a new initial position, wherein said predefined positions of the drive unit during filling of the container are recalculated in relation to the new initial position.

16. The method according to claim 15, further comprising calculating a new motion profile for the drive unit by comparing the new initial position for the drive unit with a current product volume delivered by the pump converted into length units.

17. The method according to claim 15, further comprising calculating an actual product level in the container in relation to the new initial position of the drive unit by comparing the new initial position to a current product volume delivered by the pump of the filling unit converted into length units minus a constant multiplied by the converted volume squared.

18. The method according to claim 17, further comprising calculating a speed of the pump at predefined positions of the drive unit, calculating drive unit compensation distances as a function of the pump speed at the predefined positions of the drive unit, and updating the drive unit motion profile using said drive unit compensation distances.

19. The method according to claim 18, further comprising controlling a volume of the product delivered into a fill volume of the filling unit and a volume of product delivered to the container respectively by controlling the movement of inlet and outlet valves in the filling unit.

20. A computer storage system comprising a non-transitory storage device, said computer storage system having stored thereon executable program instructions that direct a computer system of an apparatus for filling a product into a container to at least:

control a drive unit for moving the container in relation to a filling unit from a first position, in which a bottom end of the container is arranged at a maximum distance from a filling nozzle, to a second position, in which the bottom end of the container is arranged at a minimum distance from the filling nozzle;

open a first end of the filling unit and fill the product into the container;

move the container away from the first end of the filling unit by controlling the drive unit to step through a number of predefined positions while continuing to fill the product into the container;

close the first end of the filling unit when the container has been moved to a predefined end position; and calculate an acceleration of the pump at predefined positions of the drive unit in order to obtain drive unit compensation distances as a function of the pump acceleration at each predefined position of the drive unit.

* * * * *